US005135260A

United States Patent [19]

Irlik et al.

[11] Patent Number: 5,135,260

[45] Date of Patent: Aug. 4, 1992

[54] CALENDAR WITH MULTI LAYERED STRUCTURE

[76] Inventors: Jerzy Irlik; Miroslawa Irlik, both of 221 Nouveau Ct. SW., Lilburn, Ga. 30247

[21] Appl. No.: 676,195

[22] Filed: Mar. 27, 1991

[51] Int. Cl.[5] ..... B42D 5/04

[52] U.S. Cl. ..... 283/2; 283/117; 40/107

[58] Field of Search ..... 283/2, 117, 3, 4; 40/107

[56] References Cited

U.S. PATENT DOCUMENTS

| | | | |
|---|---|---|---|
| 4,226,443 | 10/1980 | Brown | 283/2 |
| 4,720,123 | 1/1988 | Chelius | 283/2 |
| 4,948,034 | 8/1990 | Rohloff | 283/2 X |
| 5,026,095 | 6/1991 | Hoyeck | 283/117 |

FOREIGN PATENT DOCUMENTS

| | | | |
|---|---|---|---|
| 2537555 | 3/1977 | Fed. Rep. of Germany | 40/107 |

*Primary Examiner*—Timothy V. Eley
*Assistant Examiner*—Willmon Fridie, Jr.

[57] ABSTRACT

A yearly calendar with multi layered structure is disclosed consisting of fundamentally identical single-faced and/or fundamentally identical double-faced sub-calendars corresponding to different periods of the year and assembled in chronological order.

In abstract a preferred embodiment is a single-faced sub-calendar comprising a base and a frame which are flat boards attached together along one edge, a screen layer, a picture layer and a top layer consisting of plurality of separate planar sub-elements and removably affixed to one face of the base in definite order. All the layers are consecutively detached and discarded or relocated upon their designated function. The top layer consist of plurality of separate planar parts creating table of time. The picture layer consist of plurality of located in random order planar portions gradually collated in the frame. The screen consist of plurality of separate planar plates temporarily concealing fragments of messages enclosed on the base.

Another embodiment includes a double-faced sub-calendar where all the layers are removably affixed to both faces of the base and each face of the frame collates the picture.

2 Claims, 2 Drawing Sheets

CALENDAR WITH MULTI LAYERED STRUCTURE

FIELD OF THE INVENTION

My invention relates to calendars and, more particularly, to the structure of calendars.

BACKGROUND OF THE INVENTION

Designing of calendars has a very broad and rich achievement. The primary task of calendars is to inform about passing time. However, a calendar can be used in various distinctive ways and therefore there is so many unique designs of the calendar.

An appearance and a structure of calendars has been determined by numerous factors, being taken for consideration, during the entire designing process. For example, where the usefulness of the calendar was considered as a priority, the design process brought forth all kinds of pocket and planner calendars. Many other designs aspired to give a calendar an original appearance and attractive aesthetic look. A good example of such design is a very popular illustrated calendar. Furthermore, to make calendar more entertaining the illustrations become designed as a numerous type of crossword puzzles, humors, etc. . . . Unfortunately, that type of entertaining gains personally and timely limited interest. Boes in his patent teaches a calendar comprising a top as a removable sheet and a lower sheet which carries a picture, all included within a frame, to activate the continues entertaining and interest in the calendar. While such a design activates continues personal participation, it still results in limited type of entertaining, which generally procures a gradual exposing of underlaying picture.

SUMMARY OF THE INVENTION

The present invention provides an improved yearly calendar consisting of fundamentally identical single-faced and/or fundamentally identical double-faced sub-calendars. Each single-faced sub-calendar and each face of double-faced sub-calendar, assembled within the same yearly calendar, corresponds to a different period of the year and is assembled in a chronological order.

The improvement comprises a sub-calendar including a base and a frame made of flat boards attached together along one edge, and a screen layer, a picture layer and a top layer consisting of plurality of separate planar sub-elements and removably affixed to one face of the base in definite order. All the layers are consecutively detached and discarded or relocated upon their designated function. This arrangement of elements dramatically expends a functional and an entertaining ability of the calendar.

The top layer consist of plurality of separate planar parts creating table of time.

The picture layer is not just exposed by removing the parts of the top layer, but additionally it is sub-divided on plurality of separate planar portions affixed to the base in random order and gradually relocated to the frame to be collated.

The screen layer contains of plurality of separate planar plates temporarily concealing fragments of messages carried by sections of the base.

It is an object of the present invention to provide a structurally improved calendar to expend a functional and an entertaining ability of the calendar.

It is a further object of the present invention to provide the improved structure creating a multi functional calendar, which in combination with various graphic designs can inform, entertain, teach and test, any person, continuously throughout the entire year.

The means by which the foregoing and other objects of the present invention are accomplished and the manner of their accomplishment will be readily understood from the following specification upon reference to the accompanying drawings.

DESCRIPTION OF THE PREFERRED EMBODIMENT

An improved yearly calendar (not shown) consists of fundamentally identical single-faced and/or fundamentally identical double faced sub-calendars. Each single-faced sub-calendar and each face of double-faced sub-calendar, assembled within a yearly calendar, corresponds to a different period of the year and is assembled in chronological order. Thus, the number of sub-calendars in the yearly calendar assembly is determined by the type of incorporated sub-calendars and the time period covered by each sub-calendar.

Figure 1:
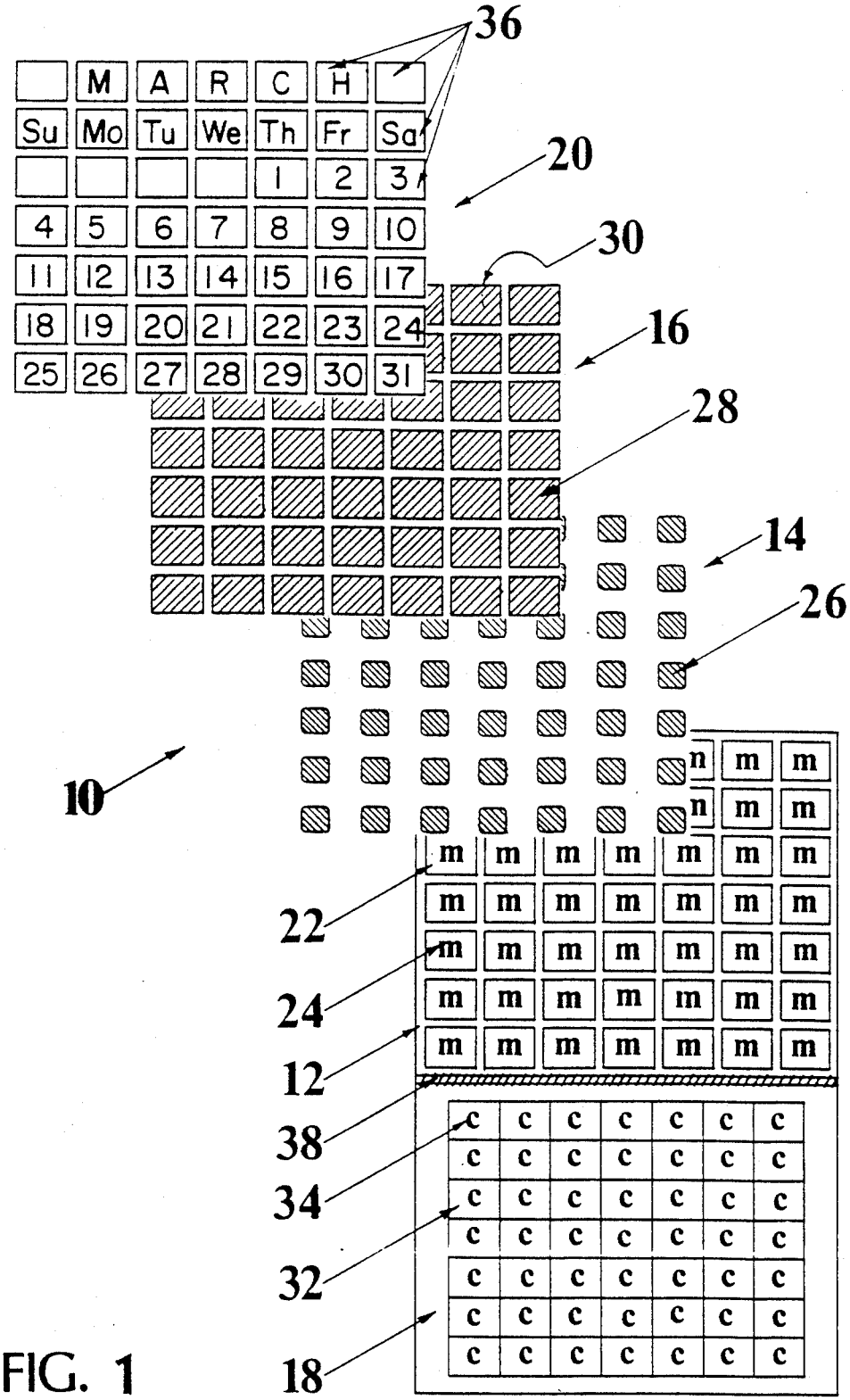
FIG. 1 is an exploded view of the single-faced sub-calendar w multi layered structure.

Having reference to the drawings, wherein like reference numerals indicate corresponding elements, there is shown in FIG. 1 an exploded view of the single-faced sub-calendar, generally denoted by reference numeral 10. The single-faced sub-calendar 10 comprises two flat boards, namely the base 12 and the frame 18, and several planar layers, namely the screen layer 14, the picture layer 16 and the top layer 20 consisting of plurality of separate planar sub-elements, described later herein.

The base 12 and the frame 18 are attached together along one edge, preferably by GBC binding 38. It should be noted that instead of binding the frame 18 and the base 12 together with a spiral binding, adhesive or hooks can be used, or both elements can be made of a single flat board folded along shown line of connection.

The base 12 supports and gathers all the layers 14, 16 and 20 of the sub-calendar 10 in a definite order. Directly to the face of the base 12 is removably affixed the screen layer 14, then the picture layer 16 is removably affixed to the base 12 over the screen layer 14, and the top layer 20 is removably affixed to the face of the picture layer 16. The method of attachment of all layers 12, 14 and 20 to the base 12 and to each other should allow for an easy separation of temporarily connected sub-elements, without potentiality of destroying them. Preferably a removable adhesive (not shown) covering the underside of one element can be used along with a non-adhesive surface of the abutting element. During life extend of the sub-calendar 10 all layers 14, 16, and 20 are consecutively detached. The removal of the layers 14, 16 and 20 begins with the top layer 20 consisting of plurality of separate parts 36 creating the table of the months, weeks and days. The number of the parts 36 forming the top layer 20 vary according to the period of time covered by the sub-calendar 10. In the preferred embodiment, as exemplified in FIG. 1, the top layer 20 covers a monthly interval and is formed of rectangular in shape and equally sized parts 36 arranged in a planar pattern of rows, seven across and seven down, a total of forty-nine separate parts. Some of the parts 36 indicate days, some weekdays and some are arranged to create the name of the month. It should be noted that the parts 36 indicating day can be also designed to be used for writing notes and appointments or to carry important day and date information. Some of the parts 36 are blank and are included in the top layer 20 to maintain the role of the top layer 20 resulting from the location of the top layer 20 in the sub-calendar 10, and that role is to cover the picture layer 16.

The parts 36 of the top layer 20 are removably affixed, preferably self-adhere, to the separate planar portions 28 forming the picture layer 16. In the preferred embodiment, exemplified in FIG. 1, the number of portions 28 in the picture layer 16 is equal to the number of the parts 36 in the top layer 20. Like the parts 36 of the top layer 20 like all portions 28 of the picture layer 16 are equally sized and rectangular in shape. The portions 28 are also slightly larger than corresponding parts 36 for easier detachment of the parts 36 from the portions 28. Thus, removal of the single part 36 from the top layer 20 expose the single portion 28 in the picture layer 16. The picture layer 16 normally signifies a planar piece of art like picture, drawing, poster or photo subdivided on plurality of portions 28 located within the picture layer 16 in random order. Thus, the consecutive removal of parts 36 does not gradually expose the accurate appearance of that planar piece of art. The exposed portions 28 are removed from the picture layer 16 and collated in the frame 18, as explained later herein.

In the preferred embodiment, the frame 18 has a surface graphically sub-divided on grid forming planar spaces 32 arranged in rows, seven across and seven down, to give a total of forty-nine spaces 32 within the confines of a rectangular flat board. Each space 32 corresponds to the single portion 28 of the picture layer 16 and is of equivalent size as the corresponding portion 28. Each space 26 of the frame 18 contains an individual clue 34 shown by a way of example in FIG. 1 as the letter c. Also, each portion 28 of the picture layer 16 contains an individual clue 30 on the underside (not seen) correlated with only one of the clues 34 enclosed within the spaces 32. The correlation of both clues 30 and 34 assigns each portion 28 of the picture layer 16 to the single space 32 of the frame 18. All clues 34 are arranged within the frame 18 in consecutive order allowing for collating all portions 28 of the picture layer 16. By matching the clue 30 and the clue 34, each portion 28 of the picture layer 16 can be accurately relocated to the space 32 and automatically collated in the frame 18 to form the final appearance of that planar piece of art signified by the picture layer 16. It is understood that the type and nature of both correlated clues 30 and 34 will be determined by a specific graphic design of the sub-calendar 10. Given as an example only, both clues 30 and 34 can means a question located on the portion 28 and an answer to this question located within the space 32, or numbers. It is believed that this arrangement creates a very interesting entertaining. The procedure is not limited only to the gradual exposing of that planar piece of art but it is expended to the task of collating the portions 28 of that planar piece of art signified by the picture layer 16.

All portions 28 of the picture layer 16 are removably affixed, preferably self-adhere, to the base 12 over the plates 26 forming the screen layer 14. It should be noted that the adhesive (not shown) on underside of the portions 28 allows also for immediate attachment of the portions 28 to the frame 18 after the relocation. When the portion 28 exposed by removed part 36 is relocated to the frame 18, the plate 26 is fully exposed.

The plates 26, normally are made of planar sheet removably affixed, preferably self-adhering, to the base 12 within the sections 22. It should be noted that optionally each plate can be formed of easy to scratch coat of paint applied directly to the surface of the base 12 within the sections 22.

In the preferred embodiment, shown in FIG. 1, the base 12 has a surface graphically sub-divided on planar sections 22 arranged in rows, seven across and seven down, to give a total of forty-nine spaces 32 within the confines of a rectangular flat board. Each section contains the message 22, by way of example shown in FIG. 1 as the letter m and explained later herein. The plates 26 of the screen layer 14 are much smaller than the sections 22 of the base 12 to temporarily conceal only a fragment of each message 24 enclosed within the section 24. Thus, the removal of portion 28 of the picture layer 16 at the same time expose the plate 26 and an uncovered fragment of the message 24 enclosed within the section 22. It is believed that such composition expends an entertaining function of the calendar and gives an opportunity for unlimited graphic design and ideas to make this part of the calendar very entertaining and challenging. Given as example only, the message 24 can include a question and an answer to this question concealed by the plate 26. With removal and discarding of the plate 26 the user can find out if his answer match the correct one. The message 24 can also carry a surprise. The user by removing plate 26 can find out does the entire message 24 fulfil the expectation carried with the uncovered fragment of the message 24.

In the preferred embodiment, as exemplified in FIG. 1, this pedicular design of the sub-calendar 10 draw the specific procedure. The removal of the single part 36 of the top layer 20 expose the single portion 28 of the picture layer 16, then the relocation of the portion 28 of the picture layer 16 to the frame 18 expose the single plate 26 of the screen layer 14, and finally, the removal of the single plate 26 expose the single message 24 within the section 22 of the base 12. As the period covered by the sub-calendar 10 expires, all portions 28 of the picture layer 16 are collated in the frame 18 and all the messages 24 are fully discovered. It should be understood that, however the number of parts 36 in the top layer 20 is determined by time period covered by the top layer 20, a number, a shape and a size of the portions 28, the plates 26, the sections 22 and the messages 24 can be designed in many different ways. For example, the picture layer 16 can consist of larger number of the portions 28 than the top layer 20 contains the parts 36, the number of messages 24 and the number of plates 26 can also be expended. In such a design each part 36 of the top layer 20 can cover one or several portions 28 of the picture layer 16 and relatively the removal of each part 36 expose one or several portions 28. The portion 28 of the picture layer 16 can cover more than one plate 26 and more than one message 24. Also the frame 18 does not have to have as many spaces 32 as the picture layer 16 has the portions 28. Some of the portions 28 can be design to have no meaning and can be given false clue or no clue at all. The sections 22 of the base 12 also can include more than one message 24. Further a shape and a size of the parts 36, the portions 28, the plates 26 and the sections 22 could be utilized in various arrangement in the sub-calendar 10.

Reduction of the number of portions 28 and the messages 24 can also be utilized but it is not recommended as the object of the invention is to expend an entertaining ability of the calendar.

From the above, it can be seen that the present invention has the power of expending entertaining and functional ability of the calendar. From foregoing, it is also believed that those skilled in the art will readily appreciate the unique futures of the present invention.

Figure 2:
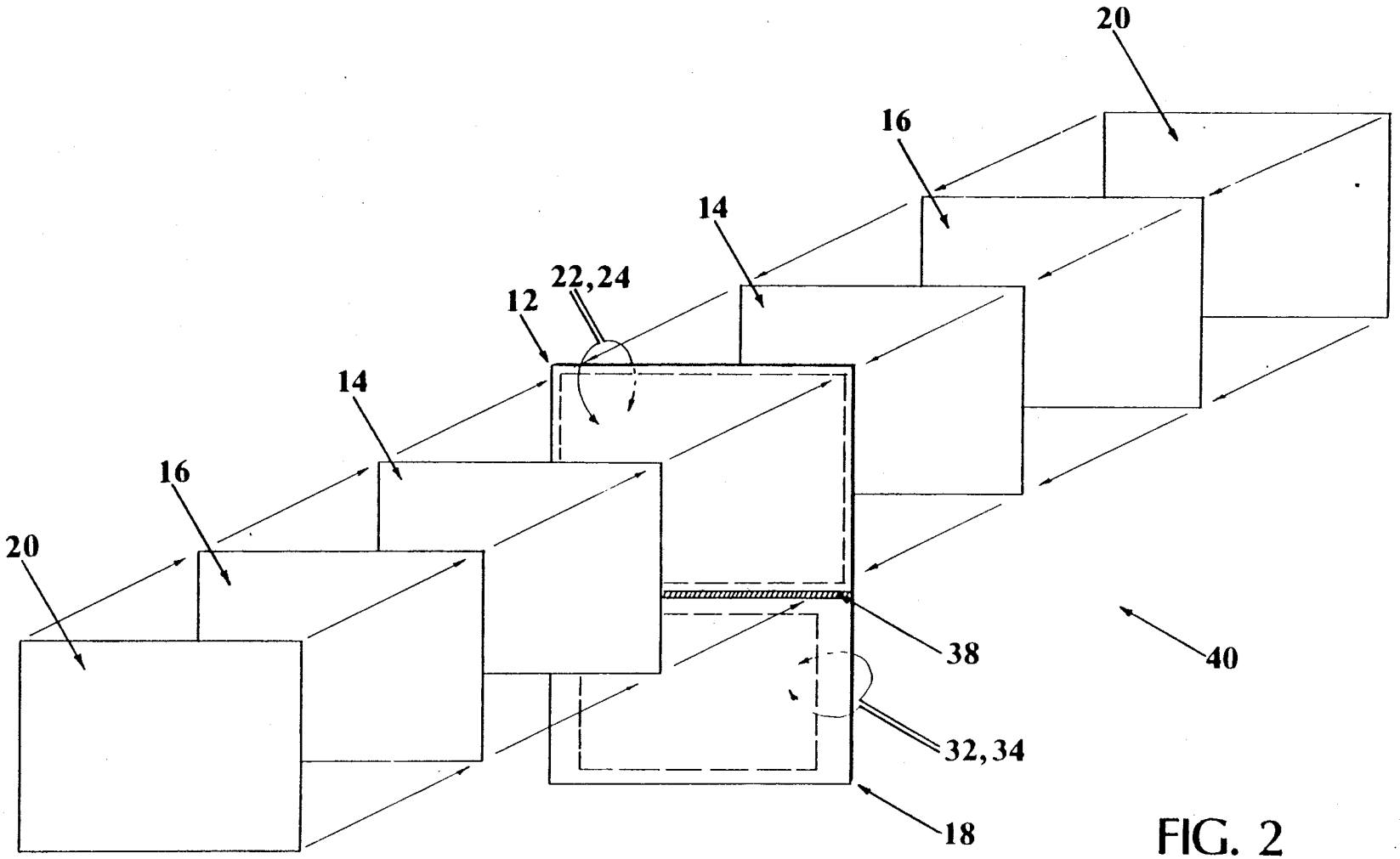
FIG. 2 is a schematic exploded view of the double-faced sub-calendar with multi layered structure.

Another embodiment of the present invention is depicted in FIG. 2 in which the single-faced sub-calendar is modified to double-faced sub-calendar, generally denoted 40. The double-faced sub-calendar 40 consist of substantially the same element 12, 14, 16, 18 and 20 as the single-faced sub-calendar 10. The modification is made only to the base 12 and the frame 18. The base 12 of the double-faced sub-calendar 40 has not got just one surface sub-divided but both surfaces are graphically sub-divided on plurality of planar sections 22. The screen layer 14, the picture layer 16 and top layer 20 are removably affixed to both faces of the base 12 in definite order as described in the single-faced sub-calendar 10. Also the frame 18 of the double-faced sub-calendar 40 has not got just one surface sub-divided but both surfaces are graphically subdivided on plurality of planar spaces 32. The portions 28 of the picture layer 16 from each side of the base 12 are relocated to the spaces 32 of the frame 18, each picture layer 16 on different side of the sub-calendar 40.

The present invention may, of course, be carried out in other specific ways than those herein set forth without departing from the spirit and essential characteristics of the invention. The present embodiments are therefore, to be considered in al respects as illustrative and not restrictive and all changes coming within the meaning and equivalency range of the appended claims are intended to be embraced therein.

What is claimed is:

1. A yearly calendar consisting of at least one single-faced sub-calendar, each single-faced sub-calendar comprising:

(a) a base being a flat board having one face graphically sub-divided on plurality of sections, each section containing a message;

(b) a screen layer consisting of plurality of separate planar plates removably affixed to said base within said sections to temporarily conceal fragments of said messages;

(c) a picture layer consisting of plurality of separate planar portions removably affixed in random order to said base over said plates of the screen layer, each portion containing an individual clue on the underside;

(d) a top layer consisting of plurality of separate planar parts removably affixed to said portions of said picture layer and creating a table of time; and (e) a frame being a flat board attached along one edge to said base and having one face graphically subdivided on plurality of spaces, each space containing an individual clue correlated to only one of said individual clues enclosed on the underside of said portions of said picture layer, said correlated clues allocating each portion of said picture to each section of the frame to collate said portions in the frame.

2. A yearly calendar consisting of at least one double-faced sub-calendar having each face corresponding to a different period of the year, each double-faced sub-calendar comprising:

(a) a base being a flat board having both faces graphically sub-divided on plurality of sections, each section containing a message;

(b) two screen layers, each screen layer consisting of plurality of separate planar plates removably affixed to different face of said base within said sections to temporarily conceal fragments of said messages;

(c) two picture layers, each picture layer consisting of plurality of separate planar portions removably affixed in random order to different face of said base over said plates of said screen layer, each portion containing an individual clue on the underside;

(d) two top layers, each top layer consisting of plurality of separate planar parts removably affixed to said portions of said picture layer on different face of the base and creating tables of time; and (e) a frame being a flat board having both faces graphically sub-divided on plurality of spaces, each space containing an individual clue correlated to only one of said individual clues enclosed on the underside of said portions of said pictures, said correlated clues allocating each portion of said picture layers to said sections of the frame to collate each picture on different face of the frame.

* * * * *